US006341439B1

(12) United States Patent
Lennerstad

(10) Patent No.: US 6,341,439 B1
(45) Date of Patent: Jan. 29, 2002

(54) INFORMATION SURFACE

(76) Inventor: Hakan Lennerstad, Bjorstorp, S-373 02 Ramdala (SE)

( * ) Notice: Subject to any disclaimer, the term of this patent is extended or adjusted under 35 U.S.C. 154(b) by 0 days.

(21) Appl. No.: 09/269,163

(22) PCT Filed: Sep. 10, 1997

(86) PCT No.: PCT/SE97/01525

§ 371 Date: Mar. 23, 1999

§ 102(e) Date: Mar. 23, 1999

(87) PCT Pub. No.: WO98/13812

PCT Pub. Date: Apr. 2, 1998

(30) Foreign Application Priority Data

Sep. 23, 1996 (SE) ..... 9603449

(51) Int. Cl.[7] ..... G09F 19/14
(52) U.S. Cl. ..... 40/453; 40/427
(58) Field of Search ..... 40/427, 442, 453, 40/454, 902; 352/100

(56) References Cited

U.S. PATENT DOCUMENTS 2,956,359 A * 10/1960 Smith et al. ..... 40/442
4,621,443 A * 11/1986 Weinreich ..... 40/437 X
4,870,768 A * 10/1989 Watt et al. ..... 40/454 X
5,035,929 A * 7/1991 Myers et al. ..... 40/454 X

FOREIGN PATENT DOCUMENTS

AU 154535 * 2/1951 ..... 40/427

* cited by examiner

*Primary Examiner*—Brian K. Green
(74) *Attorney, Agent, or Firm*—Dennison, Scheiner, Schultz & Wakeman

(57) ABSTRACT

A sign board for displaying an image so that the image can be viewed from various viewing angles without appearing distorted is disclosed. The sign board includes a first layer of material having light transmitting portions and light blocking portions arranged over a second layer of material bearing multiple distorted copies of the image. The copies are distorted by being compressed near their edges. The first layer is arranged over the second layer so that the image is visible to a viewer through the light transmitting portions substantially idependently of the angle at which the sign board is viewed.

14 Claims, 5 Drawing Sheets

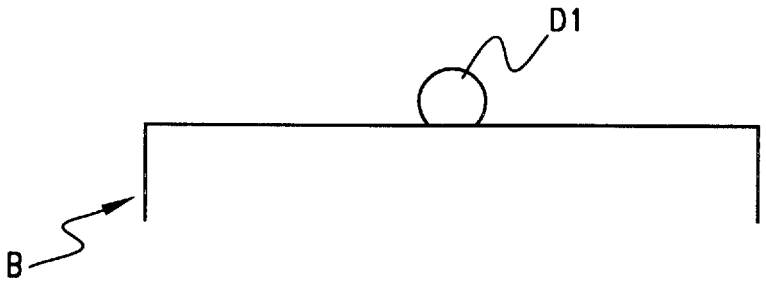
FIG.1
FIG.2a
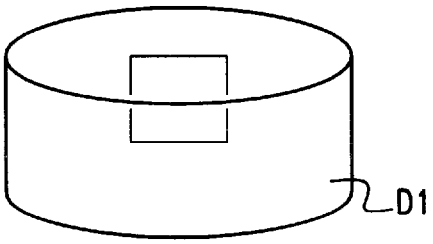
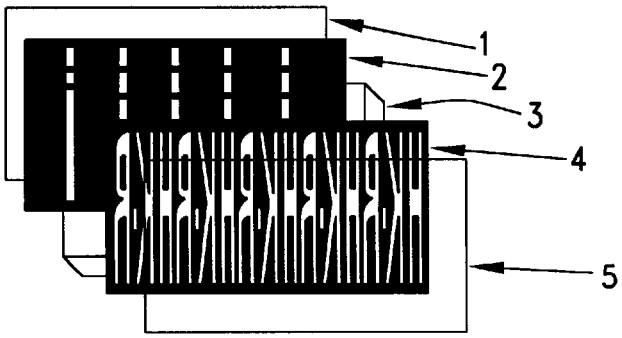
FIG.2b
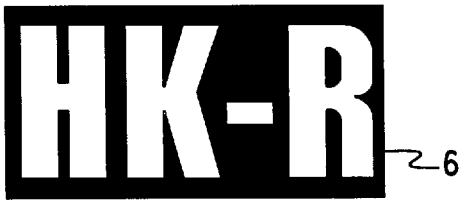
FIG.2c

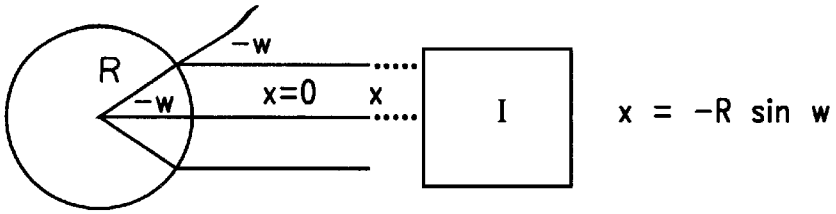
FIG.9
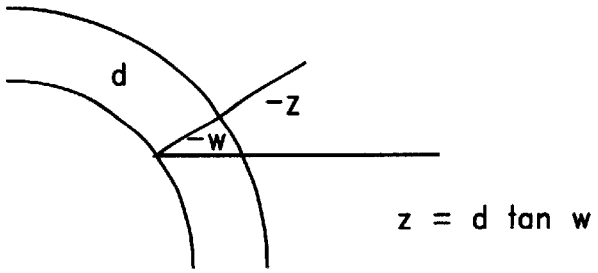
FIG.10
FIG.11
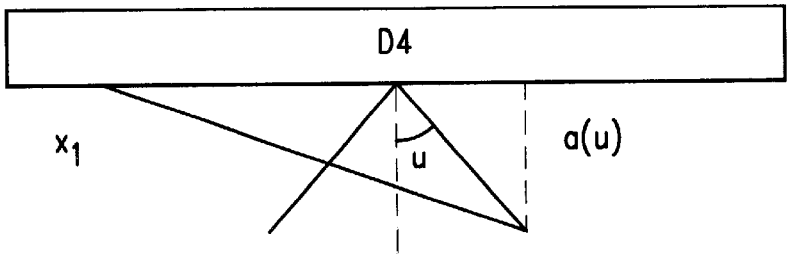
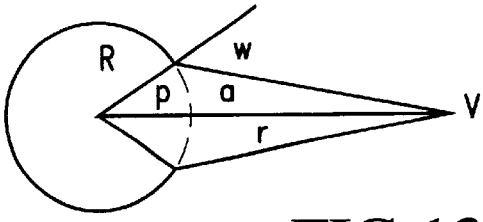
FIG.12

INFORMATION SURFACE

1. FIELD OF THE INVENTION

Information surfaces are to be found among displays shields to show certain pictures, symbols and texts. The invention regards all dimensions larger than microscopic and for use inside and outside.

2. BACKGROUND OF THE INVENTION

With the technique of today, displays, as signboards, television and computer screens, can be used for showing one image at a time only. The word "image" will in this text be used in the meaning image, symbol, text or combinations thereof. An obvious drawback of any display presently available is that when viewed from a small angle, the image appears squeezed from the sides. This deformation increases as the viewing angle becomes smaller, this is an obvious oblique viewing problem.

SUMMARY OF THE INVENTION

When using printing equipment with high resolution, an image can hold more information than the eye can detect. It is possible to compare the phenomena with a television screen. At a close look it is seen that an image here is represented by a large number of colored dots, between the dots there are information-free grey space. The directional display has such information-free space filled with information representing other images. The background illumination bring these images to appear when viewed from appropriate viewing angles.

Essentially, the ratio of the printing resolution to the resolution of the human eye under specific viewing circumstances gives an upper bound for the number of different images which can be stored in one image. This is true for the directional display in the so called one-dimensional version. In the two-dimensional version, an upper limit on the number of images is the square of that ratio. The viewer getting further from the display is clearly a circumstance which decreases the resolution of the eye with respect to the image. Hence, images intended for viewing at a long distances may in general contain more images. If the printing resolution comes close to the wavelength of the visible light, diffraction phenomena becomes noticeable. Then an absolute bound is reached for the purpose of this invention.

The resolution ratio of the printing system and the eye bounds the number of images that can be represented in a multi-image, this is also a formulation of the necessary choice between quantity of images and sharpness of images. The limits of the techniques are challenged when attempting to construct a directional display which shows many images with high resolution intended for viewing at close distance.

Directional displays are always illuminated. The one-dimensional directional display shows different images when the observer is moving horizontally, when moving vertically no new images appear. The two-dimensional display shows new images also when the viewer moves vertically. In this text we will mainly describe the one-dimensional version. A directional display can be realized in a plane, cylindrical of spherical form. Other forms are possible, however from a functional point of view equivalent to one of the three mentioned. The plane directional display has usually the same form as a conventional lighted display. The cylindrical version is shaped as a cylinder or a part of a cylinder, the curved part contains the images and is to be viewed. The spherical directional display can show different images when viewed from all directions if it is realized as a whole sphere.

The plane display has a lower production cost than the cylindrical and the spherical versions. Sometimes this version is easier to place, however it has the obvious drawback of a limited observation angle. This angle is however larger than a conventional flat display because of the possible compensation for the oblique observation problem. The cylindrical display can be made for any observation angle interval up to 360 degrees.

Showing different messages in different directions is practical in many cases. A simple example is a shop at a street having a display with the name of the shop and an arrow pointing towards the entrance of the shop. Here the arrow may point towards the entrance when viewed from any direction, which means that the arrow points to the left from one direction and to the right from the other one. The arrow can point right downwards from the other side of the street, and change continuously between the mentioned directions. Furthermore, the name of the shop can be equally visible from any angle.

A lighthouse can show the text "NORTH" when viewed from south, "NORTHWEST" when viewed from southeast, and so on. Unforeseeable artistic possibilities open. For example, a shop selling sport goods can have a display where various balls appear to jump in front of the name as a viewer passes by. The colour of the leaves of trees can change from green to yellow and red, as to show the passage of the seasons.

Another use of the directional display is to show realistic three-dimensional illusions. This is achieved simply by in each direction showing the projection of the three-dimensional object which corresponds to that direction. These projections are of course two-dimensional images. The illusion is real in the sense that objects can be viewed from one angle which from another are completely obscured since they are "behind" other objects. Compared to holograms, the directional display has the advantages that it can with no difficulties be made in large size, it can show colours in a realistic way, and the production costs are lower. Three dimensional effects and moving or transforming images can be combined without limit.

The oblique viewing problem disappears if the directional display is made in order to show the same image in all directions. In this case, for each viewer simultaneously it appears as if the display is directed straight towards him/her.

Examples of environments where many different viewing angles occur are shopping malls, railway stations, traffic surroundings, harbours and urban environments in general. One can show exactly the same image from all viewing angles with a cylindrical display on a building as shown in FIG. 1 shown in the appendix regarding the drawings.

Basic Idea

The directional display is always illuminated—either by electric light or sunlight. The surface of the display consists on the inside of several thin slits, each leaving a thin streak of light. The light goes in all directions from the slits. On the outside, in front of all slits, there is a strongly compressed and deformed transparent image. A viewer will only see the part of the images which is lighted by the light streaks. If the images are chosen appropriately, the shining lines will form an intended picture. If the viewer moves, other parts of the images printed on the outer surface will get highlighted, showing another image. The shining lines are so close together so that the human eye cannot distinguish the lines, but interprets the result as one sharp picture.

The two-dimensional version has small round transparent apertures A instead of slits S. Analogously, the viewer will see a set of small glowing dots of different colors. Similar to a TV-screen, this will form a picture if the dimensions and the colors of the dots are chosen appropriately. The rays will here highlight a spot on the outside. The set of rays which hit the viewer will change if the viewer moves in any direction.

BRIEF DESCRIPTION OF THE DRAWINGS

FIG. 1 schematically shows a display device according to the present invention mounted on the side of a building;

FIG. 2*a* shows a display device according to the present invention; FIG. 2*b* shows a portion of FIG. 2*a* enlarged and exploded to show the various layers of the device; FIG. 2*c* is an enlarged view of a portion of one of the layers of FIG. 2*b;*

FIG. 9 shows the relationship between the radius of a cylindrical display device, the width of an image, and the maximum image viewing angle;

FIG. 10 shows that an arc on the surface of a cylindrical display device may be approximated as a line segment; and, FIGS. 11–13 show the angular relationships between images and viewing angles for a display device displaying images that are distorted in two directions.

5. CONSTRUCTION

Figure 3A:
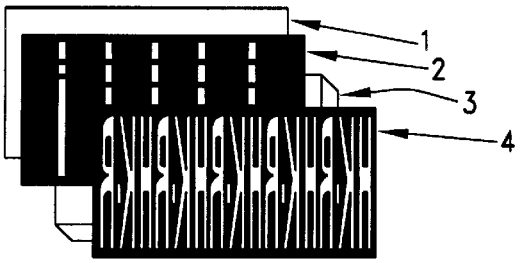
FIG. 3*a* shows a display device according to the present invention and distorted copies of an image thereon.

To start with we here describe the one-dimensional directional display. The description here is schematic. In the following mathematical sections the exact formulas are described and derived, giving desired images without deformation.

FIG. 1 schematically shows a cylindrical directional display D1 mounted on a building B. FIGS. 2*a*–2*c* show display D1 in more detail.

The top and bottom surfaces for the cylindrical directional display can be made of plate or hard plastic. On the bottom lighting fitting is mounted. The lights are centralized in the cylinder. The display can on daytime receive the light from the sun if the top surface is a one sided mirror—letting in sunlight, but not letting it out.

The curved surface consists of five layers, the layers are numbered from the inside and out.

Layer 3 is load-bearing. This is a transparent plate of glass or plexiglass—for a cylindrical display it is therefore a glass pipe or a piece of a pipe. This surface has high, but not very high, demands on uniform thickness. Existing qualities are good enough.

The inner part of layer 3 is covered by layer 2, which is completely black except for parallel vertical transparent slits of equal thickness and distance. Here the production accuracy is important for the performance of the display.

Layer 1, on the inside of layer 2, is a white transparent but scattering layer. The inner side is highly reflecting. Also the top and bottom surfaces are highly reflective. This to achieve a maximum share of the light emitted which penetrates the slits.

Layer 4 contains the images to be presented to a viewer. The image 6 on layer 4 contains of slit images—each slit image is in front of a slit. Each slit image contains a part of all images to be shown to a viewer. It will be described in the sequel how to find out the exact image to print in order to get a desired effect.

The outmost layer, layer 5, is protecting surface of glass or plexiglass.

In FIG. 2, which is shown in the enclosed appendix regarding the drawings, we consider a cylindrical directional display where the text "HK-R" is visible from all directions. Here the slit images are all equal.

Figure 3B:
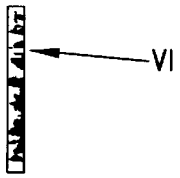
FIG. 3*b* shows a visible portion of the image of FIG. 3*a*.
Figure 3C:
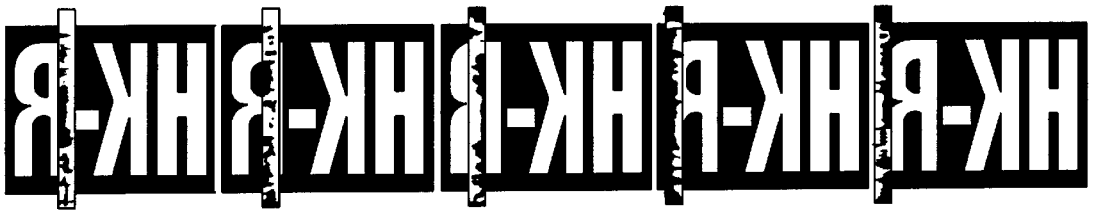
FIG. 3*c* shows the portion of each distorted image that forms the visible image in FIG. 3*b;*

FIG. 3 in the appendix regarding the drawings illustrates the function of the display of FIG. 2. The word "HK-R" is compressed from the sides, more in the middle than close to the edges, and in this form printed Note how the slits of layer 2 highlights different parts VI of the letter R, because of the rounding of the display. The straight part of "R" is clearly seen to the left of the curved part, hence the letter is turned right way round.

Figure 4:
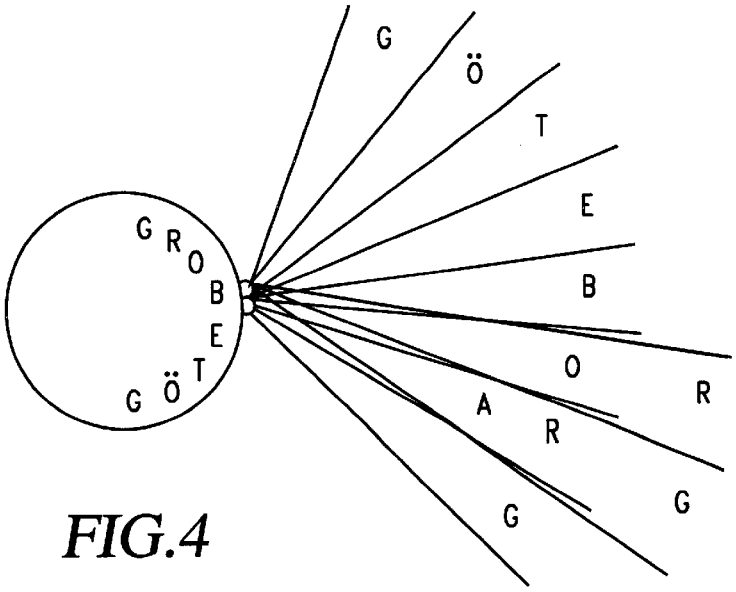
FIG. 4 shows a second embodiment of a display device according to the present invention.

In the following example (FIG. 4) in the appendix the display shows the text "Göteborg" in the same way in all directions. From two points of the display it is shown how the letters of the word is radiated in different directions. An observer at A is in the "r" and "g" sectors so that the "r" will be observed to the left of "g". This illustrates the function in a very schematic way. In a high quality display each slit shows a fraction of a letter.

A viewer closer to the display will observe the same image, only received from slightly fewer slits.

7. Formulas for Infinite Viewing Distance

In this section we consider viewing from a large distance, allowing the assumption of parallel light rays. We deduce formulas of what to print in front of each light aperture. This is what to print on layer 4 defined in section 5.

7.1 One-dimensional Display

An image can be described as a function f(x,y): here is f the colour in the point (x,y). Let us view x as a horizontal coordinate, and y as a vertical coordinate. A sequence of images to be shown can be described as a function b(x,y,u). Here u is the angle of the viewer in the plane display it is counted relatively the normal of the display. Then b(x,y,u) is the image to be shown as viewed from the angle u.

Suppose that the images correspond to the parameter values $-x_0 \leqq x \leqq x_0$, $-y_0 \leqq y \leqq y_0$ and $-u_0 \leqq u \leqq u_0$. The effective with of the display is thus $2x_0$, and the effective height is $2y_0$. The actual image area is thus $4x_0y_0$. Intended maximal viewing angle is $u_0$.

7.1.1 Plane One-dimensional Display

We first describe the mathematics for a plane, one-dimensional directional display.

As described before, at oblique viewing angle an images appear compressed from the sides. In the case of three-dimensional illusions, and in other instances, this is not desirable. If we want to cancel this effect, the images b(x,y,u) should be replaced by $b(x \cos u/\cos u_0, y, u)$. In order to see this, we first that this compression when viewed from a specific distant point is linear: Each part becomes compressed by a certain factor which is the same for all points on the picture. Therefore it is enough to consider the total width of the image at a certain viewing angle u.

Then the image b(x cos U/cos $u_0$, y, u) ends when the first argument is $x_0$, hence when $x=x_0 \cos u_0/\cos u$. Hence the width of the image on the display here is $2x_0 \cos u_0/\cos u$. At maximal angle, when $u=u_0$ we get the width $2x_0$, then we use all the display. At smaller angle the image does not use all of the surface of the display, which is natural in order to compensate away the oblique viewing problem.

Elementary geometry shows that oblique viewing gives an extra factor cos u, hence we get the observed width $2x_0 \cos u_0$ from all angles. This is independent of u, so the observed image will not appear compressed from intended viewing angles.

We suppose that the display is black outside the image area, hence when x and u are so that $x \cos u/\cos u_0 \leqq x_0$ but $|x|>x_0$.

Figure 5:
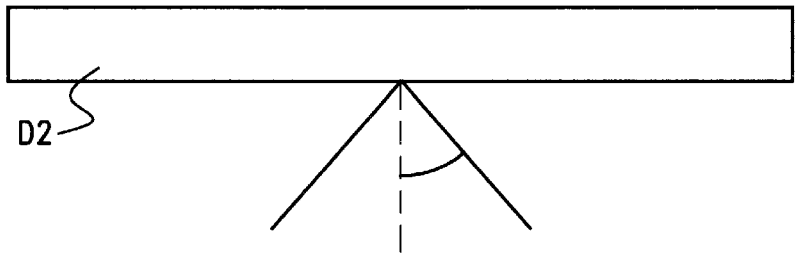
FIG. 5 shows a display and a range of angles for viewing the display.

FIG. 5 shows a flat display D2 and a range of angles at which the display can be viewed.

Figure 6:
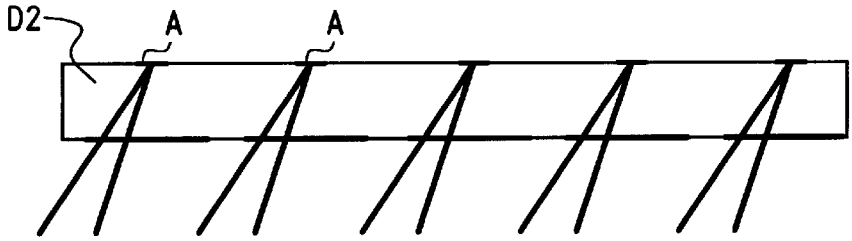
FIG. 6 shows an image on a display being viewed from two different angles.

In FIG. 6 in the appendix of the drawings it is illustrated how a given slit image contains a part of all images, but for a fixed x-coordinate. E.g., the leftmost slit image consists of the left edges of all images. Conversely, the left edges of all slit images give together the image which is to be shown from maximal viewing angle to the left.

Suppose we have in total n slits, and hence n slit images. The slit image number i which is to be printed on the flat surface is denoted by $t_i(x,y)$. Here x and y are the same variables as before, with the exception that x is zero at the middle of $t_i(x,y)$.

In order to calculate $t_i(x,y)$ from b(x,y,u) we start by discretizing in the x-coordinate. The continuous variable x is replaced by a discrete one: i=1, 2, . . . , n. The expression $x_i=x_0(2i-n-1)/n$ runs from $x=-x_0+x_0/n$ to $x=x_0-x_0/n$, it is a discretization of the parameter interval $-x_0 \leqq x \leqq x_0$ in equidistant steps in such a way that the slit images can be centered in these x-coordinates.

When a viewer moves, the viewing angle u is changed, and the x-coordinate of the slit image which is lightened up is changed. As a first step in the deduction of formulas for $t_i(x,y)$, this argument gives the slit images $s_i(x,y)=b(x_i, y, x)$.

Clearly we here get the information from b only from the straight lines with x-coordinates $x=x_0(2i-n-1)/(n-1)$. The x-coordinate for the slit image, corresponding to the angle u for the image, is not descretized—to have maximal sharpness and flexibility we discretize only in the necessary variable. The sharpness demand in the x-direction appears here: a detail in the x-direction need to have a width of at least $2x_0/n$ to appear as a part of the image.

Figure 7:
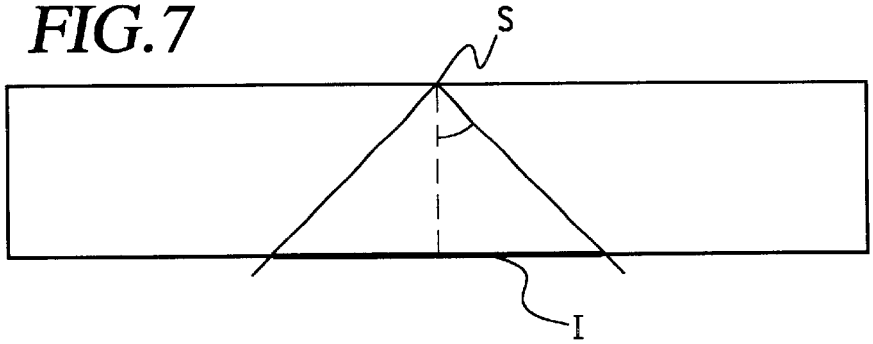
FIG. 7 shows the relationship between a slit on one layer of the display device and the image on a second layer.

Denote the distance between slit S and slit image I by d in accordance with the FIG. 7 in the appendix of the drawings. For maximal viewing angle $u_0$, the width of a slit image then need to be 2d tan $u_0$. Hence: $2dn \tan u_0<2x_0$. The distance between the slit images should be slightly larger, and colored black between the slit images, in order to avoid strange effects at larger viewing angles than $u_0$.

It is a fact that a change of a large viewing angle corresponds to a larger movement on the surface of the display than the same change of a viewing angle closer to u=0. To compensate this, images corresponding to large |u| demand more space on the surface than images corresponding to small |u|.

Simple geometry gives the relation x=d tan u, i.e. u=a tan x/d. From a sequence of images b(x,y,u) we will therefore get the following slit images:

$$t_i(x, y) = b\left(x_i \frac{d}{\sqrt{d^2+x^2}} \frac{1}{\cos u_0}, y, \operatorname{atan} = \frac{x}{d}\right).$$

Here are x and y variables on the surface of the display, centred in the middle of each slit image. The variables fulfill $|y| \leqq y_0$ and $|x| \leqq d \tan u_0$.

With the oblique viewing compensation, we get by using $\cos(a \tan z)=(1+z^2)^{-1/2}$.

$$t_i(x, y) = b\left(x_i, y, \operatorname{atan}\frac{x}{d}\right).$$

The images are printed so that x i oriented horizontally and y vertically, and so that the image $t_i(x,y)$ is centred in $(x_i,0)$. If these formulas are implemented as a computer program, the production of directional displays be almost completely automatized.

7.1.2 Cylindrical One-dimensional Display

Now suppose that the display is cylindrical. To start with, we here do not need to compensate for the oblique viewing effect as in the plane case—no angle is different from another. However, the curvature of the cylindrical surface gives rise to another kind of oblique viewing effect—the middle part appears to be broader than the edge-near parts. Another difference compared to the plane case is that the left edge of an image is printed as a right edge of a slit image, and vice versa. This have been described in section 6.

It is desired to compute what to print at the cylindrical surface. This can practically be done by printing on the surface directly, or by printing on a flat film which is wrapped around the transparent cylinder. The arc length on the cylinder is used as a variable.

Here the angles are discretized—we have a finite number of slits. Let us consider a whole cylindrical directional display. As before we have a sequence of images, here b(x,y,u) is the image to be observed from the angle u, where $0 \leqq u \leqq 360$. Suppose that, relatively a certain fixed zero-direction, the angles of the slits are $u_k=360(i-1)/n$ degrees, i=1, 2, . . . , n. At each slit $u_i$ light is emitted within the angle range $2w_0$: the angle w fulfills $-w_0 \leqq w \leqq w_0$. Simple geometry shows that the angle w at slit $u_k$ should show the image given by the angle $u=u_i+w$.

The width of the image is $2x_0$, the radius of the cylinder is R and the maximal angle $w_0$ are related as $2x_0=2R \sin w_0$.

Figure 8:
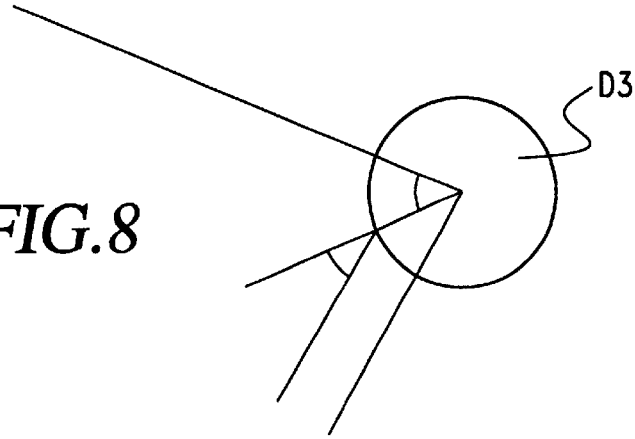
FIG. 8 shows different angles for viewing an image on a cylindrical display device.

FIG. 8 shows a second cylindrical display D3.

As is clear from FIGS. 8 and 9 in the appendix, for x, R and w are related as x=−R sin w.

Except for small n, the arc length can locally be estimated with a straight line as in FIG. 10, with a sufficient accuracy this gives w=a tan(z/d). Exact formula can be derived by eliminating x, y and q of the four equations $x^2+y^2=R^2$, X=y cot w+R−d, R sin q=y and $z=qR\pi/180$. With w=a tan(z/d), we get the following formula from desired image b(x,y,u) to image $t_i(z,y)$ to be printed $$t_i(z, y) = b\left(-R\frac{z}{\sqrt{d^2+z^2}}, y, u_i + \operatorname{atan}\frac{z}{d}\right).$$

$x_0=Rz_0(z_0^2+d^2)^{-1/2}$, which also can be written as $z_0=d(R^2-x_0^2)^{-1/2}$. We also need $z_0 \leqq \pi R/n$ in order to avoid overlap between the slit images. The images $t_i(z,y)$ are displaced $2\pi R/n$ to each other, possible gaps are made black. The slit images are printed in parallel, centred in $(z_i, 0)$, where $z_i=u_i 2\pi R/360$. Here z is a coordinate for the length on a film to be placed on a cylindrical surface. The total length of the film is $2\pi R$. The height $2y_0$ is the width of the film.

7.2 Two-dimensional Display

A collection of images to be shown with a two-dimensional directional display can be described with a function b(x, y, u, v). Here u is a horizontal angle and v a vertical angle, a viewing angle to the display is now given by the pair (u,v). As before, x and y are x- and y-coordinates, respectively, for a point on an image in the sequence of images, given by the angles u and v.

Suppose that the sequence of images corresponds to the parameter values $-x_0 \leqq x \leqq x_0$, $-y_0 \leqq y \leqq y_0$, $-u_0 \leqq u \leqq u_0$, and $-v_0 \leqq v \leqq v_0$. The effective width of the display is therefore $2x_0$ and the effective height is $2y_0$.

In this version, both variables x and y have to be discretized. Analogously we get the discretizations $x_i = x_0(2i-n-1)/(n-1)$ for x and $y_j = y_0(2j-m-1)/(m-1)$ for y. This gives a cross-ruled pattern with in total mn nodes. For each pair (i,j) we have a node image $t_{ij}(x,y)$, it covers a square around the point $(x_i, y_j)$. The width of the square is $2x_0/n$, and its height is $2y_0/m$.

7.2.1 Plane Two-dimensional Display

Suppose that the display is two-dimensional and plane.

In the case v=0, we have the same phenomena as in the case of the one-dimensional display—the only difference is that now is also the y-variable discretized. This gives $$t_{ij}(x, 0) = b\left(x_i, y_j, \operatorname{atan}\frac{x}{d}, 0\right).$$

Hence, the node image (i,j) at (x, 0) is to show a colour given by the point $(x_i, y_j)$ of the image given by the pair of angles (u,v)=(a tan x/d, 0). In the same way we then get for u=0.

$$t_{ij}(0, y) = b\left(x_i, y_j, 0, \operatorname{atan}\frac{y}{d}\right).$$

At an arbitrary point (x,y) at the node image (i,j) we therefore have $$t_{ij}(x, y) = b\left(x_j, y_j, \operatorname{atan}\frac{x}{d}, \operatorname{atan}\frac{y}{d}\right)$$

to give intended image when viewed from the angle (u,v). With the oblique viewing compensation both in the x- and y-directions analogously to the one-dimensional case we obtain $$t_{ij}(x, y) = b\left(x_i \frac{d}{\sqrt{d^2+x^2}} \frac{1}{\cos u_0}, y_j \frac{d}{\sqrt{d^2+y^2}} \frac{1}{\cos v_0}, \operatorname{atan}\frac{x}{d}, \operatorname{atan}\frac{y}{d}\right).$$

These images are printed so that $t_i(x,y)$ is centred in the point $(x_i, y_j)$.

7.2.2 Cylindrical Two-dimensional Display

Suppose that the cylindrical display is oriented so that it is curved in x-direction and straight in the y-direction; hence the axis of the cylinder is parallel to the y-axis and perpendicular to the x-axis. The angles in x-direction is discretized to the angles $u_i$, the variable y is discretized into $y_j$. This is analogous to the method for the one-dimensional cylindrical and plane display, respectively. In the case u=0 we then have the same phenomena as in the case of the one-dimensional plane display, with the only exception that both variables are discretized. We get $$t_{ij}(0, y) = b\left(0, y_j, u_i, \operatorname{atan}\frac{y}{d}\right).$$

The case v=0 is obtained from the one-dimensional cylindrical display:

$$t_{ij}(x, 0) = b\left(-R\frac{x}{\sqrt{d^2+x^2}}, y_j, u_i + \operatorname{atan}\frac{x}{d}, 0\right).$$

This gives:

$$t_{ij}(x, y) = b\left(-R\frac{x}{\sqrt{d^2+x^2}}, y_j, u_i + \operatorname{atan}\frac{x}{d}, \operatorname{atan}\frac{y}{d}\right).$$

With the oblique viewing compensation in the y-direction we get $$t_{ij}(x, y) = b\left(-R\frac{x}{\sqrt{d^2+x^2}}, y_j \frac{d}{\sqrt{d^2+y^2}} \frac{1}{\cos v_0}, u_i + \operatorname{atan}\frac{x}{d}, \operatorname{atan}\frac{y}{d}\right).$$

7.2.3 Spherical Two-dimensional Display

Here we refer to the discussion in section 8.2.3 concerning the construction of a spherical two-dimensional display for limited viewing distance. The procedure described here can be used also for unlimited viewing distance.

8. Formulas for Limited Viewing Distance

Suppose now that the display is viewed from a given distance a. Some displays can be sensitive for the viewing distance, and should in such a case be constructed as described in this section. With similar geometrical and mathematical considerations we get formulas transforming desired images to an image to print as follows.

8.1 One-dimensional Display

For each viewing angle u the display is made so that it shows desired image at the distance a(u). This makes it possible to construct displays which shows exactly the a desired image at each spot on an arbitrary curve in front of the display. When moving straight towards a point on the display it is not possible to change image close to that point. Therefore we have a condition of such a curve: The tangent of the curve should in no point intersect the display. This condition is fulfilled for example by a straight line which does not intersect the display.

8.1.1 Plane One-dimensional Display

A sequence of images to be shown with the directional display can be described with a function b(x,y,u). The angle u denotes here the horizontal angle of the viewer relatively the surface of the display, with apex at the centre of the display.

Suppose now that a viewer at angle u is on the distance a(u) orthogonally to the plane of the display.

Similar considerations as in the previous section then gives the slit images.

$$t_i(x, y) = b\left(x_i, y, \operatorname{atan}\left(\frac{x}{d} + \frac{x_i}{a(u)}\right)\right)$$

without the oblique viewing compensation. Regard FIG. 11 in the appendix showing a second flat display D4. Here and in the following we have u=u(x)=a tan(x/d).

In order to compensate the oblique viewing effect it is necessary to divide the viewing angle in several equal parts. For a given u, the angle w of the viewer fulfills the inequalities $w_1(a)=a\tan(\tan u-x_0/a(u))\leqq w\leqq a\tan(\tan u+x_0/a(u))=w_2(a)$. Then $f_i(a, u)=(2a\tan(\tan u-x_i/a(u))-w_2(a)-w_1(a))/(w_2(a)-w_1a))$ is a function with values from −1 to 1 as i=1, . . . , n, and splits the interval for the viewing angle in n parts of equal size. This gives $$t_i(x, y) = b\left(x_0 f_i(a, u), y, \operatorname{atan}\left(\frac{x}{d} + \frac{x_i}{a(u)}\right)\right).$$

This formula is normally enough if the viewing is at the same height as the display. Otherwise it might be necessary to compensate for vertical oblique viewing effect also. Suppose that the viewer is at height h above the horizontal mid plane of the display. The vertical angle r for the viewer relatively a certain slit is then in the interval $r_1(a)=a\tan(\cos u(-h-y_0)/a(u))\leqq r\leqq a\tan(\cos u(-h+y_0)/(a(u))=r_2(a)$. The function $g(y, u)=(a\tan(\cos u(-h+y)/a(u))-r_2(a)-r_1(a))/(r_2(a)-r_1(a)$ then takes its values in the interval (−1, 1). At the same time the distance to the display increases, hence a(u) need to be replaced by $(a(u)^2+(h-y)^2)^{1/2}$. This gives $$t_i(x, y) = b\left(x_0 f_i\left(\sqrt{a^2 + (h-y)^2}, u\right), y_0 g(y, u), \operatorname{atan}\left(\frac{x}{d} + \frac{x_i}{\sqrt{a^2 + (h-y)^2}}\right)\right)$$

for the case with oblique viewing compensation both in x- and y-directions.

8.1.2 Cylindrical One-dimensional Display

With notation according to the FIG. 12 in the appendix we have $\sin p=b/R$ and $\tan r=b/(a+R+(R^2-b^2)^{1/2})$. The heights of the triangles are apparently b. We have furthermore that −w=p+r. By elimination of b and p from these three equations we get $\sin r=-R\sin w/(a(u)+R)$. At the same time we have x=d tan w. This gives $$t_i(x, y) = b\left(-x_0\frac{2}{\pi}\operatorname{asin}\left(\frac{R}{R+a}\frac{x}{\sqrt{x^2+d^2}}\right), y, u_k + \operatorname{atan}\left(\frac{x}{d} + \frac{x_i}{a}\right)\right).$$

With vertical oblique viewing effect we get analogously:

$$t_i(x, y) = b\left(\xi(x, y), y_0 g(y, u), u_k + \operatorname{atan}\left(\frac{x}{d} + \frac{x_i}{\sqrt{a^2 + (h-y)^2}}\right)\right).$$

where $$\xi(x, y) = -x_0\operatorname{asin}\left(\frac{R}{R+\sqrt{a^2+(h-y)^2}}\frac{x}{\sqrt{x^2+d^2}}\right)\left(\operatorname{asin}\left(\frac{R}{R+a}w_0\right)\right)^{-1}.$$

8.2. Two-dimensional Display

Displays of the kind described in this section allows the viewer to move on a possibly bending surface in front of the display, parametrized by u and v, and everywhere get an intended image. Analogously to the previous case, this is possible only if there is no tangent to the surface which intersects the display. For example, if the surface is a plane not intersecting the display, all tangents are in the plane and the condition is fulfilled. This case is realized by a display on a building wall a few meters above the ground close to a plane horizontal square.

There is a horizontal angle u and a vertical angle v relatively a normal to the display. The angles have apices in the centre of the display. When viewed at angle (u,v) the distance is a(u,v) the display. The distance is orthogonal distance, i.e. for the plane display we think of distance to the infinite plane of the display, in the case of a cylinder we prolong the cylinder into an infinite cylinder in order to always be able to talk about orthogonal distance.

8.2.1 Plane Two-dimensional Display

Without the oblique viewing compensation there is analogously obtained $$t_{ij}(x, y) = b\left(x_i, y_j, \operatorname{atan}\left(\frac{x}{d} + \frac{x_i}{a}\right), \operatorname{atan}\left(\frac{y}{d} + \frac{y_i}{a}\right)\right).$$

With the oblique viewing compensation in the x-direction there is obtained $$t_{ij}(x, y) = b\left(x_0 f_i(a, u), y_j, \operatorname{atan}\left(\frac{x}{d} + \frac{x_i}{a}\right), \operatorname{atan}\left(\frac{y}{d} + \frac{y_i}{a}\right)\right),$$

and with oblique viewing compensation both in x- and y-directions give $$t_{ij}(x, y) = b\left(x_0 f_i(a, u), y_0 f_i', (a, v), \operatorname{atan}\left(\frac{\bar{x}}{d} + \frac{x_i}{a}\right), \operatorname{atan}\left(\frac{\bar{y}}{d} + \frac{y_i}{a}\right)\right).$$

Here $f_i(a, u)=(2a\tan(\cos v(\tan u-x_i)/a(u,v))-w_2(a)-w_1(a))/w_2(a)-w_1,(a))$, $w_1(a)=a\tan(\cos v(\tan u-x_0)/a(u,v))$, $w_2(a)=a\tan(\cos v(\tan u+x_0)/a(u,v))$.

For the angle v we have analogously $f_1'(a, v)=(2a\tan(\cos u(\tan v-y_j)/a(u,v))-z_2(a)-z_1(a))/(z_2(a)-z_1(a))=z_1(a)=a\tan(\cos u(\tan v-y_0)/a(u,v)),z_2(a)=a\tan(\cos u(\tan v+y_0/a(u,v))$.

8.2.2 Cylindrical Two-dimensional Display

Here geometrical arguments give $$t_{ij}(x, y) = b\left(-x_0\frac{2}{\pi}\operatorname{asin}\left(\frac{R}{R+a}\frac{x}{\sqrt{x^2+d^2}}\right), y_j, u_k + \operatorname{atan}\left(\tan u + \frac{x_i}{a(u, v)}\right), \operatorname{atan}\left(\tan v + \frac{y_i}{a(u, v)}\right)\right)$$

With the oblique viewing compensation we have $$t_{ij}(x, y) = b\left(\xi(x, y), y_0 g(y, u), u_k + \operatorname{atan}\left(\frac{x}{d} + \frac{x_i}{\sqrt{a^2+(h-y)^2}}\right), \operatorname{atan}\left(\tan v + \frac{y_i}{a(u, v)}\right)\right), \text{ where}$$

$$\xi(x, y) = -x_0\operatorname{asin}\left(\frac{R}{R+\sqrt{a^2+(h-y)^2}}\frac{x}{\sqrt{x^2+d^2}}\right)\left(\operatorname{asin}\left(\frac{R}{R+a}w_0\right)\right)^{-1}.$$

8.2.3 Spherical Two-dimensional Display

In the spherical case the display is a whole sphere or a part of a sphere. Here explicit formulas are considerably harder to derive, partially since there is no canonical way to distribute points on a sphere in an equidistant way. Furthermore, printing here cannot be made on plane paper, hence the use of explicit formulas would be of less significance. We therefore only describe a possible production method.

The display can be printed by in the first step produce all of the display except the printing of the desired images on the spherical surface. At the openings on the inside of the display, sensitive cells are placed. The display is covered with photographic light sensitive transparent material, however the cells need to be far more light-sensitive. A projector LS containing the desired images is placed at appropriate distance to the display. A test light ray with luminance enough to affect a cell only is emitted from the projector. When a cell is reached by such a test ray, a strong ray is emitted from the projector containing the part of the image intended to be seen from the corresponding point on the sphere. The width of the ray is typically the width of the opening. This procedure is repeated so that all openings on the spherical display have been taken care of.

The method can be improved by using a computer overhead display. Here the position of all openings can be computed, and corresponding openings can be made at the overhead display. The intended image can then be projected on the overhead display, giving the right photographic effect at all openings at the same time. From a practical viewpoint it is probably easier to rotate the spherical surface than moving the projector.

8. Precision

Figure 13:
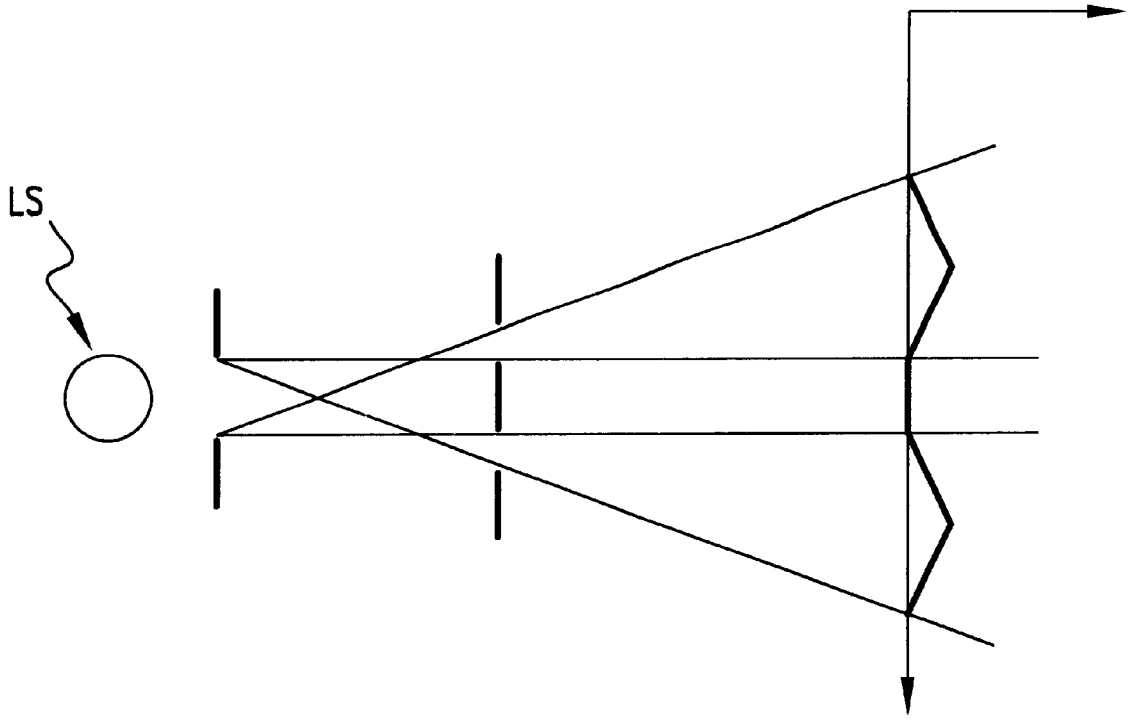

According to the following figure, the precision demands that the width of the slits or openings need to be sufficiently small. This width should not be larger than the width of the smallest detail to be seen on the display. Regard FIG. 13 in the appendix with the drawings.

What is claimed is:

1. A sign board for displaying an image so that the image appears undistorted over a range of viewing angles comprising:

a laminate having a first layer and a second layer, said first layer having light-transmitting portions and light blocking portions; and, said second layer comprising multiple distorted copies of an image to be displayed, each of said copies of an image having at least first and second edges and a width between said edges, each image being compressed to a degree in at least the width direction, the degree of compression varying across the width; and, a light source mounted next to said second layer;

said light transmitting portions of said first layer being positioned over said distorted copies of said image whereby said image is visible to a person on the side of said laminate opposite from said light source over a range of viewing angles.

2. The sign board as claimed in claim 1, wherein the laminate is flat and the image is one-dimensional, characterized in that the degree of compression is determined by the formula $$t_i(x, y) = b\left(x_i \frac{d}{\sqrt{d^2 + x^2}} \frac{1}{\cos u_0}, y, \operatorname{atan}\frac{x}{d}\right).$$

where x and y are centered coordinates in front of the light transmitting portions each having a center at the point $(x_i, 0)$, where d is the distance between the two layers, b(x,y,u) is the color at the point (x,y) for the image to be viewed from, an angle u relative to the perpendicular, and $u_0$ is the maximum viewing angle.

3. The sign board as claimed in claim 1, wherein the laminate is cylindrical and the image is one-dimensional, characterized in that the degree of compression is determined by the formula $$t_i(z, y) = b\left(-R\frac{z}{\sqrt{d^2 + z^2}}, y, u_i + \operatorname{atan}\frac{z}{d}\right)$$

where z and y are centered coordinates in front of the light transmitting portions, y is parallel to the axis of the cylindrical laminate whereas Z is orthogonal to the axis of the cylindrical laminate, d is the distance between the two layers, R is the radius of the cylindrical laminate, b(x,y,u) is the color at the point (x,y) for the image to be viewed from an angle u relative to the perpendicular of the sign, and $u_1$ is the angle for a light transmitting portion i.

4. The sign board as claimed in claim 1, wherein the laminate is flat and the image is two-dimensional, characterized in that the degree of compression is determined by the formula $$t_{ij}(x, y) = b\left(x_i \frac{d}{\sqrt{d^2 + x^2}} \frac{1}{\cos u_0}, y_j \frac{d}{\sqrt{d^2 + y^2}} \frac{1}{\cos v_0}, \operatorname{atan}\frac{x}{d}, \operatorname{atan}\frac{y}{d}\right)$$

where x and y are centered coordinates in front of a light transmitting portion (i,j) with a center at a point $(x_i, j_i)$, d is the distance between the two layers, b(x,y,u) is the color at the point (x,y) for the image to be viewed from an angle u horizontally and v vertically relative to perpendicular of the sign, and u0 and $v_0$ are maximum viewing angles.

5. The sign board as claimed in claim 1, wherein the laminate is cylindrical and the image is two-dimensional, characterized in that the degree of compression is determined by the formula $$t_{ij}(x, y) = b\left(-R\frac{x}{\sqrt{d^2 + x^2}}, y_j \frac{d}{\sqrt{d^2 + y^2}} \frac{1}{\cos v_0}, u_i + \operatorname{atan}\frac{x}{d}, \operatorname{atan}\frac{y}{d}\right)$$

where x and y are centered coordinates in front of a light transmitting portion (i,j) having a center at the point $(R_{ui}, y_j)$, d is the distance between the two layers, b(x,y,u,v) is the color at the point (x,y) for the image to be viewed horizontally from an angle u relative to the perpendicular of the sign and vertically from an angle v relative to a given zero direction orthogonally to the axis of the cylindrical laminate, and $v_0$ is the maximum viewing angle.

6. The sign board as claimed in claim 1, wherein the laminate is flat and is viewed from a finite distance, and wherein the image is one-dimensional, characterized in that the degree of compression is determined by the formula $$t_i(x, y) = b\left(x_0 f_i\left(\sqrt{a^2 + (h - y)^2}, u\right), y_0 g(y, u), \operatorname{atan}\left(\frac{x}{d} + \frac{x_i}{\sqrt{a^2 + (h - y)^2}}\right)\right)$$

where $f_1(a,u)=(2a\ \tan)\tan\ u-x_1/a(u))-w_2(a)-w_1(a))/w_2(a)-w_1(a))$, $w_1(a)=a\ \tan(\tan\ u-x_0/a(u))$, $w_2(a)=a\ \tan(\tan\ u+x_0/a(u))$, $g(y,u)=a\ \tan(\cos\ u(-h+y)/a(u)-r_2(a)-r_1(a))/(r_2(a))$, $r_1(a)=a\ \tan(\cos\ u(-h-y_0)/a(u))$, $r_2(a)=a\ \tan(\cos\ u(-h+y_0)/a(u))$, x and y are centered coordinates in front of a light transmitting portion i with its center at the point $(x_i,0)$, d is the distance between the two layers, b(x,y,u) is the color at the point (x,y) for the image to be viewed from an angle u relative to the mid-point perpendicular of the sign board, h is the height of a viewer above the mid-line of the sign board and a(u) is the distance of the viewer to the plane of the sign at the viewing angle u.

7. The sign board as claimed in claim 1, wherein the laminate is cylindrical and is viewed from a finite distance, and wherein the image is one-dimensional, characterized in that the degree of compression is determined by the formula $$t_i(x, y) = b\left(\xi(x, y), y_0 g(y, u), u_k + \operatorname{atan}\left(\frac{x}{d} + \frac{x_i}{\sqrt{a^2 + (h - y)^2}}\right)\right)$$

$$\text{där} \quad \xi(x, y) = -x_0 \operatorname{asin}\left(\frac{R}{R + \sqrt{a^2 + (h - y)^2}} \frac{x}{\sqrt{x^2 + d^2}}\right)\left(\operatorname{asin}\left(\frac{R}{R + a} w_0\right)\right)^{-1}$$

g(y,u)=(atan(cos u(−h+y)/(u))−$r_2$(a)−$r_1$(a))/($r_2$(a)−$r_1$(a)), $r_1$(a)=atan(cos u−(−h−y0)/a(u)), $r_2$(a)=a tan(cos u(−h+y0/a(u)), x and y are centered coordinates in front of light transmitting portion i, y is parallel to the axis of the cylinder and x is orthogonal to the axis of the cylindrical laminate, d is the distance between the two layers, R is the radius of the cylindrical laminate, b(x,y,u) is the color at the point (x,y) for the image to be viewed from an angle u relative to the perpendicular of the sign board, h is the height of a viewer relative to the mid-line of the sign board, a is the distance of the viewer to the plane of the sign board and $u_i$ is the angle of the light transmitting portion i.

8. The sign board as claimed in claim 1, wherein the laminate is flat and is viewed from a finite distance, and wherein the image is two dimensional, characterized in that the degree of compression is determined by the formula $$t_{ij}(x, y) = b\left(x_0 f_1(a, u), y_0 f_1'(a, v), \operatorname{atan}\left(\frac{x}{d} + \frac{x_1}{a}\right), \operatorname{atan}\left(\frac{y}{d} + \frac{y_1}{a}\right)\right)$$

where $f_1$(a,u)=(2 a tan/cos v(tan u−$x_1$)/a(u,v))−$w_2$(a)−$w_1$(a))/$w_2$(a)−$w_1$(a)), $w_1$(a)=a tan(cos v(tan u−$x_0$)/a(u,v)), $w_2$(a)=a tan(cos v(tan u+$x_0$)/a(u,v)), $f_1$(a, v)=(2 a tan(cos u(tan v−$y_i$)/a(u,v)−$z_2$(a)−$z_1$(a))/($z_2$(a)−$z_1$(a)), $z_1$(a)=a tan(cos u(tan v−$y_0$)/a(u,v)), $z_2$(a)=a tan(cos u(tan v+$y_0$)/a(u,v)), x and y are centered coordinates in front of a light transmitting portion i having a center at the point ($x_1$, $y_i$), d is the distance between the two layers, b(x,y,u) is the color at the point (x,y) for the image to be viewed horizontally from an angle u and vertically from an angle v, both relative to the perpendicular of the sign board, h is the height of a viewer above the mid-line of the sign and a(u,v)=a(a tan x/d, a tan y/d) is the distance of the viewer to the plane of the sign at the horizontal viewing angle u and the vertical viewing angle v.

9. The sign board as claimed in claim 1, wherein the laminate is cylindrical and is viewed from a finite distance, and wherein the image is two-dimensional, characterized in that the degree of compression is determined by the formula $$t_{ij}(x, y) = b\left(\xi(x, y), y_0 g(y, u), u_k + \operatorname{atan}\left(\frac{x}{d} + \frac{x_i}{\sqrt{a^2 + (h - y)^2}}\right), \operatorname{atan}\left(\tan v + \frac{y_i}{a(u, v)}\right)\right)$$

$$\text{där} \quad \xi(x, y) = -x_0 \operatorname{asin}\left(\frac{R}{R + \sqrt{a^2 + (h - y)^2}} \frac{x}{\sqrt{x^2 + d^2}}\right)\left(\operatorname{asin}\left(\frac{R}{R + a} w_0\right)\right)^{-1}$$

g(y,u)=(a tan(cos u(−h+y)/a(u))−$r_2$(a)−$r_1$(a))/($r_2$(a)−$r_1$(a)=a tan(cos u−(−h−$y_0$)/a(u)), $r_2$(a)=a tan(cos u(−h+$y_0$)/a(u)), x and y are centred coordinates in front of a light transmitting portion i, y is parallel to the axis of the cylinder and x is orthogonal to the axis of the cylindrical laminate, d is the distance between the two layers, b(x,y,u) is the color at the point (x,y) for the image to be viewed horizontally from an angle u and vertically from an angle v, both relative to the perpendicular of the sign board, h is the height of a viewer relative to the mid-line of the sign board, and a(u,v)=a((a tan x/d, a tan y/d) is the distance of the viewer to the plane of the sign at the horizontal viewing angle u and vertical angle v.

10. The sign board of claim 1, wherein said light-transmitting portions of said first layer comprise a plurality of linear slits.

11. The sign board of claim 10, wherein each of said distorted copies are mirror-inverted.

12. The sign board of claim 1 wherein said light-transmitting portions comprise a plurality of circular openings.

13. The sign board of claim 1, further including at least one layer of transparent protective material mounted over said second layer.

14. The sign board of claim 1, wherein each of said light-transmitting portions is either a linear slit or a circular opening.

* * * * *